US005245518A

United States Patent [19]

Aspenwall

[11] Patent Number: 5,245,518

[45] Date of Patent: Sep. 14, 1993

[54] LIGHTING SYSTEM

[75] Inventor: John E. Aspenwall, Lehi, Utah

[73] Assignee: Jahabow Industries, Inc., Owensville, Mo.

[21] Appl. No.: 941,202

[22] Filed: Sep. 4, 1992

[51] Int. Cl.[5] ..... H01R 33/00

[52] U.S. Cl. ..... 362/226; 362/217; 362/260; 439/159

[58] Field of Search ..... 313/318; 439/152, 156, 439/157, 159, 232, 233, 234, 366, 372; 362/133, 216, 217, 226, 260

[56] References Cited

U.S. PATENT DOCUMENTS

| | | | |
|---|---|---|---|
| 661,505 | 11/1900 | Erikson | 362/125 |
| 665,264 | 1/1901 | Petz | 362/126 |
| 723,943 | 3/1903 | Taussig et al. | 362/287 |
| 845,652 | 2/1907 | La Berge | 362/126 |
| 1,134,132 | 4/1915 | Hotchkin | 248/74.3 |
| 1,764,999 | 6/1930 | Biller | 362/294 |
| 1,927,254 | 9/1933 | Benjamin | 362/306 |
| 2,303,156 | 11/1942 | Bryant et al. | 439/232 |
| 2,336,587 | 12/1943 | Bixby | 439/233 |
| 2,569,662 | 10/1951 | Fallek | 439/232 |
| 2,663,851 | 12/1953 | Pistey | 439/232 |
| 2,982,847 | 5/1961 | Enright | 362/30 |
| 3,064,124 | 11/1962 | Husby et al. | 362/221 |
| 3,466,594 | 9/1969 | Detch | 439/233 |
| 4,042,292 | 8/1977 | Chensky | 439/159 |
| 4,302,800 | 11/1981 | Pelletier | 362/250 |
| 4,383,289 | 5/1983 | Lewin | 362/216 |
| 4,464,707 | 8/1984 | Forrest | 362/222 |
| 4,535,393 | 8/1985 | Aspenwall | 362/217 |
| 4,598,341 | 7/1986 | Brackhahn et al. | 362/125 |
| 4,713,019 | 12/1987 | Gaynor | 439/232 |
| 4,739,454 | 4/1988 | Federgreen | 362/133 |
| 4,774,645 | 9/1988 | Iwamoto | 362/226 |
| 4,994,943 | 2/1991 | Aspenwall | 362/219 |
| 5,040,101 | 8/1991 | Aspenwall | 362/125 |

FOREIGN PATENT DOCUMENTS

| | | | |
|---|---|---|---|
| 260047 | 9/1991 | France | 362/260 |
| 9204580 | 3/1992 | PCT Int'l Appl. | 362/260 |

*Primary Examiner*—Albert J. Makay
*Assistant Examiner*—Alan B. Cariaso
*Attorney, Agent, or Firm*—W. Reid Russell

[57] ABSTRACT

A lighting system that includes an essentially oval housing with end caps arranged for snap fitting and binding therein, and a surface or which housing is somewhat flattened as a mounting surface with holes formed therethrough for receiving screw type fasteners. The housing contains a ballast, double fluorescent tube holder and wiring for connection to a source of electrical energy, and a switch arrangement. The double fluorescent tube holder is accessible through a rectangular opening formed through the housing outer surface for receiving a single coupling end of a double fluorescent tube. The housing rectangular opening is to receive a translucent rectangular lens that is bent into a bow for installation, such that the forked long sides of the rectangular lens each receive an edge of one of the rectangular opening long sides fitted therein. Additionally, the invention includes a tube extractor that consists of a thin flat section of a semi-flexible, electrically non-conductive material wherefrom a center area has been removed leaving parallel legs separated by a web, the open center area for fitting across, with the parallel legs straddling, the connector end of the double fluorescent tube and is sandwiched between the tube holder and the double fluorescent tube coupling end. The tube extractor to be manually flexed to slide or jack the double fluorescent tube coupling end out of the tube holder.

10 Claims, 2 Drawing Sheets

LIGHTING SYSTEM

BACKGROUND OF THE INVENTION

1. Field of the Invention

This invention relates to lighting systems for under-cabinet use or for mounting in a display cabinet and in particular to modular fluorescent tube lighting systems that include an integral tube removal arrangement.

2. Prior Art

Lighted display cases or cabinets with glass covered faces through which products maintained within which cases or cabinets can be viewed have long been known and in common use. As have modular container mounted incandescent and fluorescent tube lights arranged for screw mounting to the undersurface of a cabinet, or the like.

Heretofore a number of light socket and fixture arrangements have been developed, with examples of lamp sockets shown in U.S. Pat. Nos. 2,303,156 to Bryant, et al; 2,569,662 and Fallek. Fixture arrangements for illuminating a display cabinet, or the like, are shown in U.S. Pat. Nos. 661,505to Erikson; 665,264 to Petz; 723,943 to Taussig, et al; 845,652 to La Berge; 1,134,132 to Hotchkin; 1,764,999 to Biller; 1,927,254 to Benjamin; 3,064,124 to Husby, et al, 4,464,707 to Forrest; 4,598,341 to Brackhahn, et al; and 4,739,454 to Federgreen. Also a lamp fixture for an instrument is shown in a U.S. Pat. No. 2,982,847 to Enright. None of the lighting arrangements of the above cited patents, however, employ the particular modular fluorescent tube lighting system with an integral tube extractor like that of the present invention.

A modular lighting assembly is shown in a U.S. Pat. No. 4,302,800 to Pelletier, and the present inventor is the inventor of three U.S. patents for lamp systems and housings, U.S. Pat. Nos. 4,535,393; 4,994,943; and 5,040,101. None of these light and lighting systems patents, however, show the particular modular fluorescent tube lighting system of the present invention where the housing is shaped together and does not have fasteners, as screws, nuts, or other connectors, presenting a smooth surface appearance. Similar to the present invention, the U.S. Pat. No. 4,535,393 to Aspenwall does include a lamp positioning device, and tubular lamp locking devices are shown in U.S. Pat. Nos. 2,336,587 to Bixby, 2,663,851 to Pistey; and 3,466,594 to Detch. Which devices are, however, structurally unlike the double fluorescent tube extractor included with the present invention.

BRIEF SUMMARY OF THE INVENTION

It is a principal object of the present invention in a lighting system to provide a fluorescent tube lighting system for mounting in a display cabinet or to the undersurface of a kitchen type cabinet, or the like, where the housing is assembled from snap together components to have a smooth surface appearance.

Another object of the present invention is to provide a fluorescent tube lighting system housing that has an attractive oval shape, with no exposed connectors, and includes a lens that is configured to snap into a housing opening, providing essentially a continuation of the smooth housing surface.

Still another object of the present invention is to provide, as a component of the lighting system, a double fluorescent tube extraction device.

Still another object of the present invention is to provide a fluorescent tube lighting system that has a smooth attractive surface, is self contained, and is easily installed in a display cabinet, under a kitchen type cabinet, or the like.

In accordance with the above objects, the lighting system of the present invention includes an essentially oval shaped housing wherein are mounted a conventional ballast and a single conventional fluorescent tube holder for receiving a double fluorescent tube, which holder is electrically connected through a switch to a source of electrical energy.

The housing receives a double fluorescent tube that has a single male coupling end and is fitted into the tube holder. Electrical contacts in the tube holder making contact with two pairs of contacts a double tube single male coupling end, completing an electrical circuit therethrough. The double fluorescent tube, prior to fitting into the tube holder, receives a tube extractor fitted thereto. The tube extractor is a flat tab of a semi-resilient, electrically non-conductive material. Which tube extractor is a thin U-shaped section of a non-conductive resilient material. The center area of the tube extractor is open, separating parallel legs with a web therebetween, the open center area for passing over which tube holder male coupling end. Pin holes are formed through the extractor parallel legs where-through connector pins of the double fluorescent tube coupling end are passed. The flat tube extractor is for sliding into engagement with and between the double tube end surface and tube holder as the double tube is fitted into which tube holder. The stiff flexible material of the fluorescent tube extractor allows an operator to manually flex the extractor web away from the holder to provide for sliding or jacking the double tube coupling end out of the tube holder.

The double fluorescent tube, when mounted in the tube holder, is opposite to a rectangular opening that is formed through the housing, which opening receives a lens fitted thereover. The lens is preferably formed from a translucent semi-rigid material, is arched across its narrow width, and the lens long edges are forked. The lens forked edges are each to receive an edge of a long side of the housing rectangular opening, providing a smooth surface appearance when the lens is mounted therein.

Other objects and features of the invention will become apparent from the following detailed description in conjunction with the drawings disclosing what is presently contemplated as being the best mode of the invention.

DESCRIPTION OF THE DRAWINGS

In the drawings that illustrate that which is presently regarded as the best mode for carrying out the invention.

DETAILED DESCRIPTION

Figure 1:
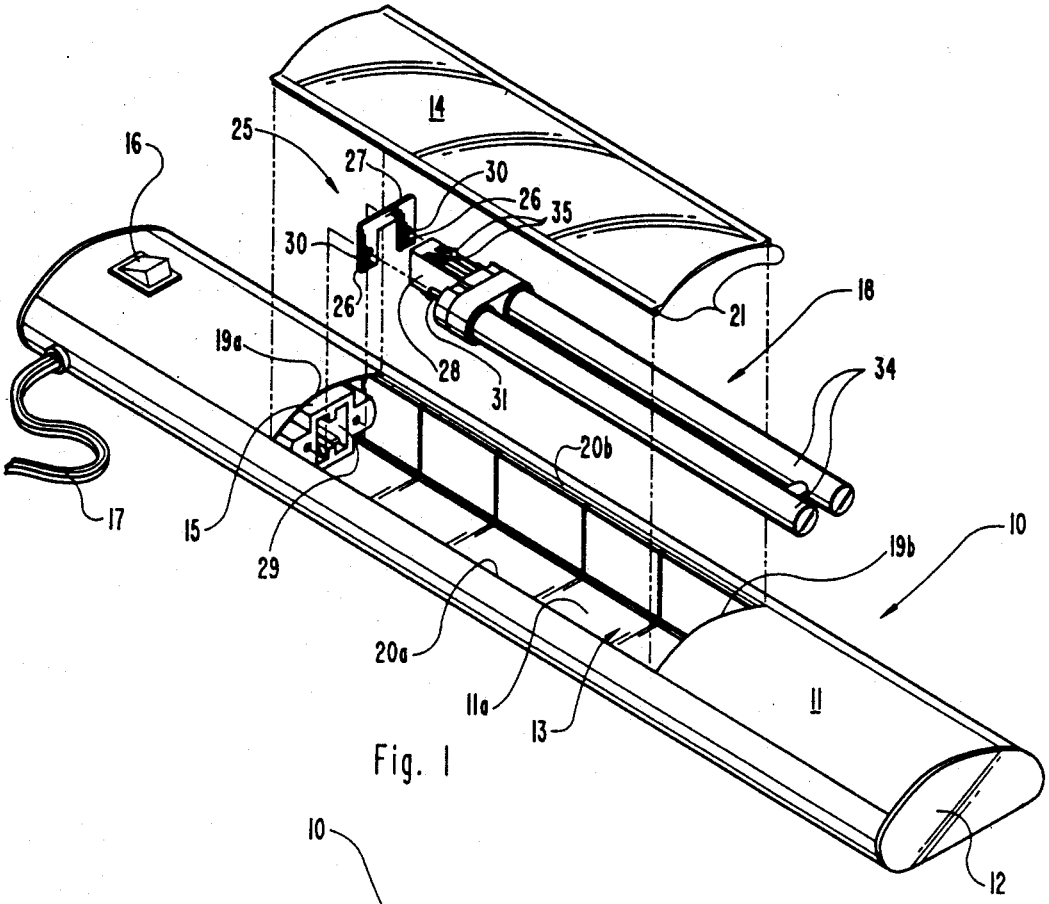
FIG. 1 is a profile perspective exploded view of the lighting system of the invention taken from the right side, front and above showing a double fluorescent tube exploded away from a double fluorescent tube extractor and from a tube holder, and showing a lens exploded from covering engagement over a rectangular opening that is formed through a lighting system oval housing.
Figure 2:
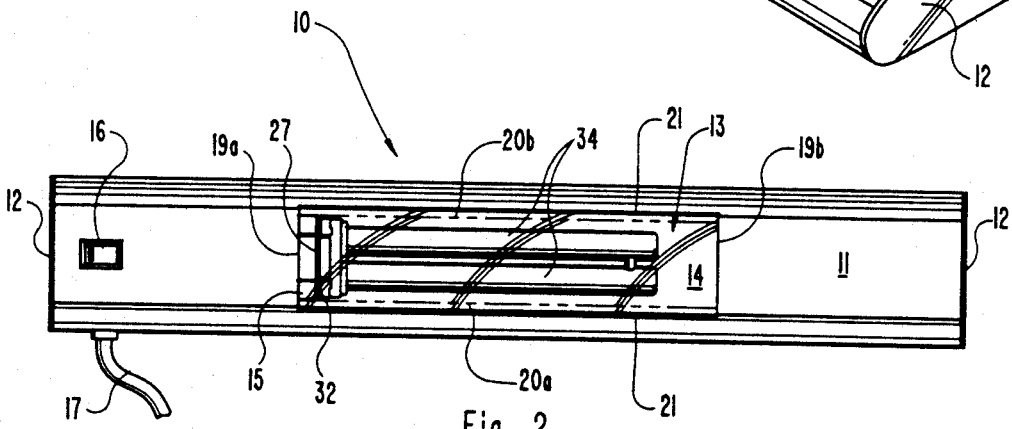
FIG. 2 is a bottom plan view of the lighting system of FIG. 1.
Figure 3:
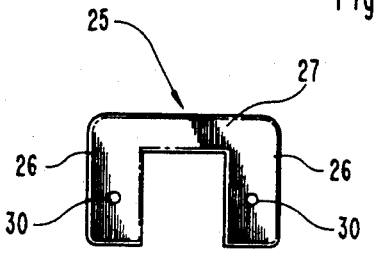
FIG. 3 is a front elevation view of the double fluorescent tube extractor shown removed from the oval housing of FIG. 1.
Figure 4:
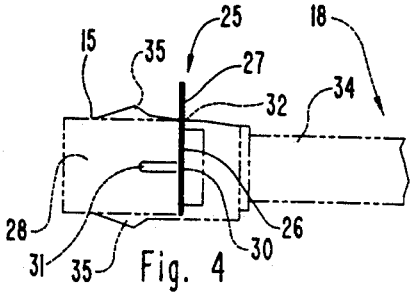
FIG. 4 is a side elevation view of the double fluorescent tube extractor of FIG. 3, shown sandwiched between a connector end of the double fluorescent tube and tube holder of FIG. 1, that are shown in broken lines.
Figure 5:
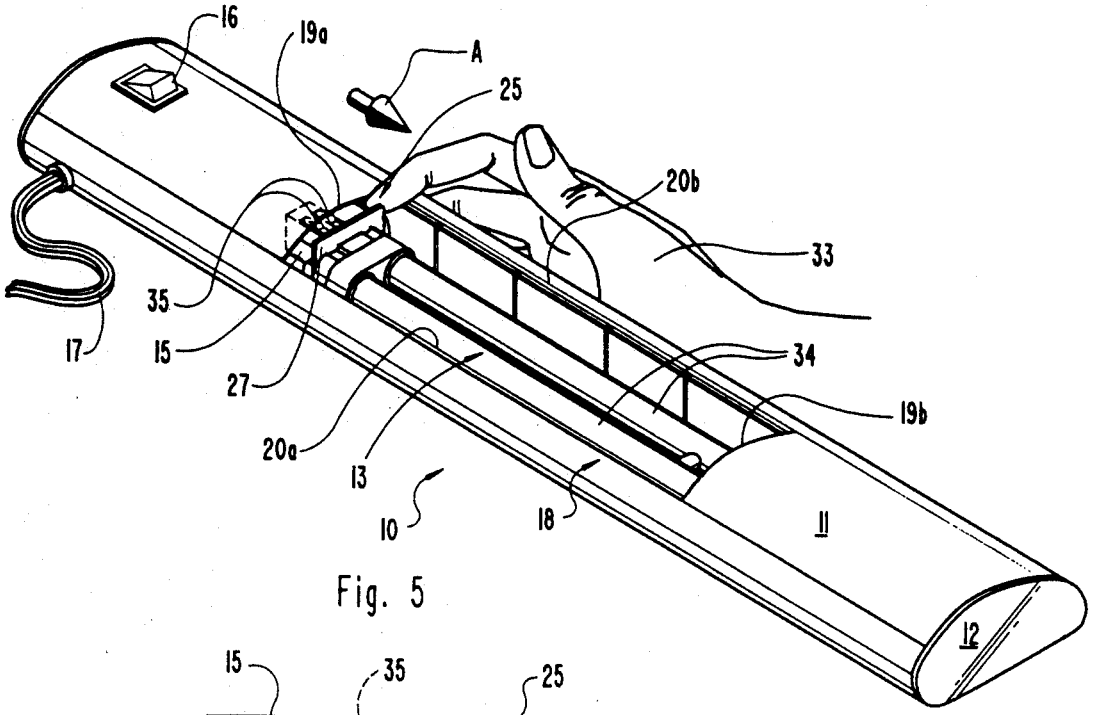
FIG. 5 is a side elevation perspective view like that of FIG. 1, showing an operator using their index finger to bend the double fluorescent tube extractor, illustrated by arrow A, to slide or jack the double fluorescent tube out of the tube holder.
Figure 6:
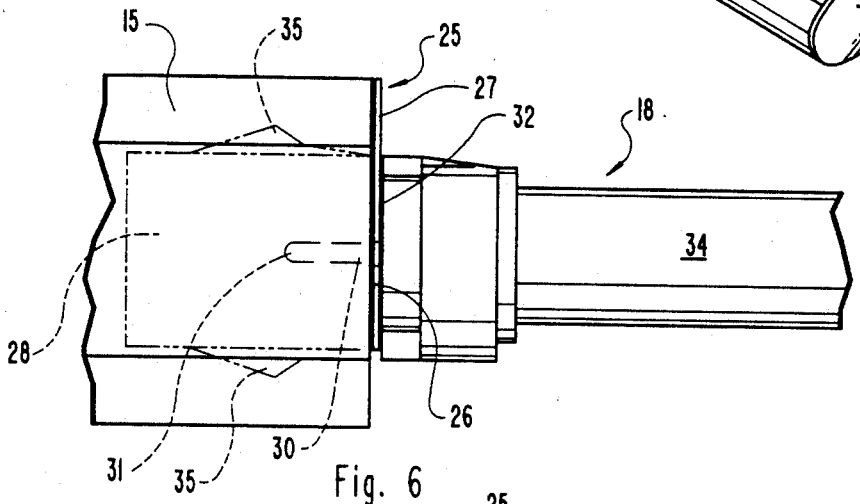
FIG. 6 is an enlarged top plan view of the double fluorescent tube coupling end, double fluorescent tube extractor and tube holder shown removed from the lighting system oval housing of FIG. 5.
Figure 7:
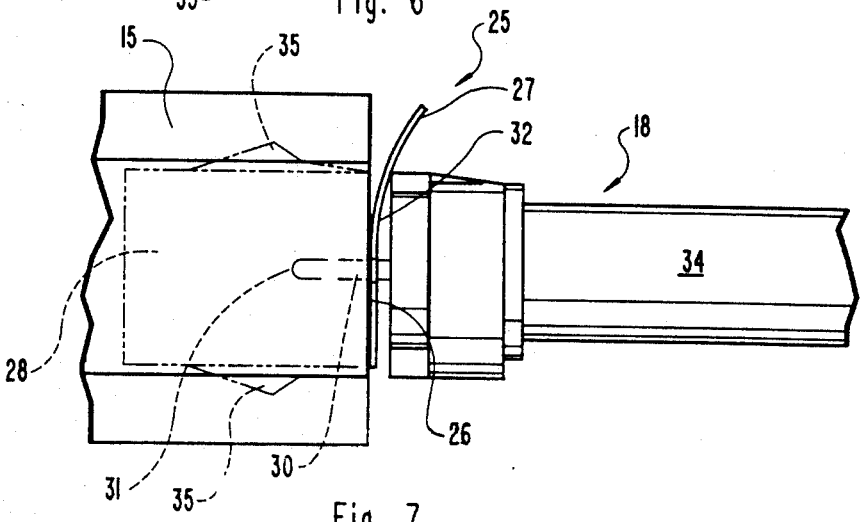
FIG. 7 is a view like FIG. 6 only showing the double fluorescent tube extractor bent to slide or jack the double fluorescent tube coupling end out of the tube holder.

A lighting system 10 of the invention is shown in FIG. 1, and is hereinafter referred to as light. Light 10 includes an essentially oval housing 11, hereinafter referred to as housing, that is open at its ends to receive end caps 12 fitted therein in binding engagement. The housing 11 while it is essentially oval has a somewhat flat mounting surface 11*a* for closely fitting onto a flat mounting surface. Through which housing surface 11*a* holes, not shown, are formed for passing screws or like fasteners, not shown, that are turned into the mounting surface. A rectangular opening 13 that includes parallel short sides 19*a* and 19*b* and parallel long sides 20*a* and 20*b* is formed through an outer rounded surface of housing 11, as shown in FIGS. 1, 2 and 5. A translucent lens 14 is arranged for fitting into the cover of the rectangular opening 13 and is releasable therefrom for providing access into the housing, as discussed below.

A ballast is maintained within which housing 11, not shown, that is wired to a fluorescent tube holder 15 through a switch 16, that is mounted in the housing 11, adjacent to rectangular opening 13. An electrical cord 17 is shown in FIG. 1 fitted into housing 11 that connects to a source of electrical power, to pass electrical energy through switch 16. So arranged, when switch 16 is manually operated, electrical power is present at the tube holder 15 to illuminate a double fluorescent tube 18 fitted therein, as discussed below.

Shown in FIGS. 1, 2 and 5, the tube holder 15 is mounted in housing 11, below a short side 19*a* of the rectangular opening 13. The long parallel sides 20*a* and 20*b*, respectively, of the rectangular opening 13 are shown as thin edges that are to fit between legs of fork edges 21 of the lens 14. Which lens 14 is preferably formed from a translucent material that is preferably a somewhat flexible material such as a Mica Board plastic.

For installing lens 14 over the rectangular opening 13, the already arched lens 14 is further manually flexed to provide an additional arch or bow therein. A lens 14 first forked edge 21 is then fitted into one of the parallel sides 20*a* or 20*b* edges, followed by rotating the lens 14 into the rectangular opening and releasing the collapsing pressure thereon. The lens, on release, flexes outwardly, urging the other lens forked edge 21 into the edge of the other rectangular opening parallel side 20*a* or 20*b*. Removal of the lens 14 out of covering engagement over the rectangular opening 13 is the reverse of the above. An operator, with their finger nails fitted under an outer leg of which lens forked edge 21, applying a force across the lens to increase the lens bow until that forked edge clears the parallel side 20*a* or 20*b*. Thereafter, the operator rotates the lens 14 outwardly around the other forked edge 21 that is fitted to the other parallel side 20*a* or 20*b*. The lens is then removed from the housing opening 13.

With the lens 14 removed, as shown in FIGS. 1 and 5, the tube holder 15 end is exposed and is ready to receive or have removed therefrom the double fluorescent tube 18. To facilitate removal of the double fluorescent tube 18, the present invention employs a double fluorescent tube extractor 25, hereinafter referred to as tube extractor. The tube extractor 25 is preferably a flat section of a semi-rigid material, such as a cured epoxy resin on a glass substrate, known as Synthane Taylorclad, manufactured by Synthane-Taylor Corporation, that is electrically non-conductive. The tube extractor 25 therefore is a thin flat section with parallel legs 26 that extend, at right angles, from ends of a web 27, and is open between its parallel legs. The open area of the tube extractor 25 is of a shape to accommodate fitting of a male coupling member 28 of the fluorescent tube 18 between the tube extractor parallel legs 26. The tube extractor parallel legs 26 are to straddle the male coupling member 28 with the web 27 resting thereon. The male coupling member 28, as shown best in FIG. 1, is, of course, for fitting into a female receptacle 29 of tube holder 15.

The tube extractor 25 parallel legs 26 are each holed at 30, with each hole for receiving an outwardly extending pin 31 of the double fluorescent tube 18 that is fitted therethrough. FIGS. 1 and 2 and 5 through 7, show the tube extractor 25 legs 26 and web 27 slid along the fluorescent tube male coupling member 28, with the fluorescent tube pins 31 fitted through the holes 30 in each parallel leg 26. The tube extractor 25 is thereby sandwiched between a double fluorescent tube coupling end 32 and the face of the tube holder 15. Shown best in FIG. 5, to remove the double fluorescent tube 18 out from tube holder 15, an operator, shown as hand 33, with their finger applies a force thereto. The applied force, illustrated by arrow A, to the tube extractor web 27, is directed away from the tube holder. The tube extractor 25 is thereby flexed from the attitude shown in FIG. 6 to the attitude shown in FIG. 7. In which FIG. 7 attitude, the tube extractor 25 web 27, as shown, is flexed away from the tube holder 15 end, the tube extractor legs 26 functioning like pry bars, acting against the double fluorescent tube coupling end 32. The double fluorescent tube end is thereby axially urged out of the tube holder female receptacle.

A utilization of the tube extractor 25 for fluorescent tube removal minimizes the likelihood of damage as could occur should the operator pull on the tubes 34. Which pulling out of tubes 34 could break an electrical connection between the fluorescent tube pin or pins 31 and contact or contacts 35 thereof. The pins 31 and contacts 35 are, of course, the fluorescent tube 18 positive and negative poles or contacts and are for electrical connection to contacts in the fluorescent tube holder 15, provides for passage of electrical power to illuminate the double fluorescent tube 18 on operation of the switch 16.

Although a preferred form of my invention has been shown and described herein, it should be understood that the present disclosure is made by way of example only and that variations are possible without departing from the subject matter coming within the scope of the following claims and a reasonable equivalency thereof, which subject matter I regard as my invention.

I claim:

1. A lighting system comprising, a housing having an essentially uniform oval cross section and includes a flat mounting surface formed along the length thereof; means for attaching said housing flat mounting surface onto a surface; a rectangular lens opening formed in said housing surface, opposite to said flat mounting surface; a pair of end caps, each for binding without external fasteners in said housing ends; a translucent rectangular lens for fitting over said housing rectangular opening that includes, as a means for maintaining said lens to said housing, forked edges formed along said lens long sides, the open area between legs of each said fork for fitting over a long side edge of said housing rectangular opening; a tube holder mounted in said housing such that a female fluorescent tube receptacle of said tube holder adjacent to an end of the housing rectangular opening for receiving a coupling end of a double fluorescent tube; means for connecting said tube holder to a source of electrical energy; and tube extractor means for arrangement between an end of said tube holder and an end of said double fluorescent tube coupling end for manual manipulation by an operator for sliding said double fluorescent tube coupling end out of said tube holder.

2. A lighting system as recited in claim 1, wherein the translucent lens is formed from a semi-rigid plastic material that can be flexed into a bow and will return to its original shape when the flexure force is released.

3. A lighting system as recited in claim 1, wherein the means for providing electrical energy is a switch that is arranged in the housing wired between the tube holder and a source of electrical energy.

4. A lighting system as recited in claim 1, wherein the double fluorescent tube includes a single coupling end that has a pair of positive and negative poles extending therefrom, each pair connecting to one of the two fluorescent tubes.

5. A lighting system as recited in claim 1, wherein the tube extractor means is a thin flat section of a semi-rigid, non-conductive material wherefrom a center section has been removed, forming a U-shape with parallel legs and a web therebetween, said U-shape section for fitting over, with the parallel legs straddling, the double fluorescent tube coupling end, sliding therealong to where it is sandwiched between the tube holder end and said double fluorescent tube coupling end with the double fluorescent tube fitted into said tube holder.

6. A lighting system as recited in claim 5, wherein the tube extractor parallel legs each have a hole formed therethrough for passing a pin that extends axially from each side of the double fluorescent tube coupling end.

7. A lighting system as recited in claim 5, wherein the tube extractor is formed from a cured epoxy resin on a glass substrate.

8. A double fluorescent tube extractor for a lighting system comprising, a thin flat section of a semi-rigid, non-conductive material wherefrom a center section has been removed leaving a U-shaped section with parallel legs and a web, said U-shaped section for fitting over, with the parallel legs straddling a coupling end of a double fluorescent tube, sliding therealong to where said thin flat section is sandwiched between a tube holder end and a double fluorescent tube coupling end when said double fluorescent tube coupling end is fitted into said tube holder.

9. A double fluorescent tube extractor for a lighting system as recited in claim 8, wherein the fluorescent tube extractor parallel legs each have a hole formed therethrough for passing a pin that extends axially from a side of the double fluorescent tube coupling end.

10. A double fluorescent tube extractor for a lighting system as recited in claim 8, wherein the tube extractor is formed from a cured epoxy resin on a glass substrate.

* * * * *